US011262150B1

(12) United States Patent
VanFossan

(10) Patent No.: US 11,262,150 B1
(45) Date of Patent: Mar. 1, 2022

(54) MUZZLE BRAKE

(71) Applicant: William Ronald VanFossan, Dandridge, TN (US)

(72) Inventor: William Ronald VanFossan, Dandridge, TN (US)

( * ) Notice: Subject to any disclaimer, the term of this patent is extended or adjusted under 35 U.S.C. 154(b) by 0 days.

(21) Appl. No.: 17/083,444

(22) Filed: Oct. 29, 2020

(51) Int. Cl.
*F41A 21/36* (2006.01)
*F41A 21/32* (2006.01)

(52) U.S. Cl.
CPC ..... *F41A 21/36* (2013.01); *F41A 21/325* (2013.01)

(58) Field of Classification Search
CPC ..... F41A 21/32; F41A 21/34; F41A 21/36
See application file for complete search history.

(56) References Cited

U.S. PATENT DOCUMENTS 3,298,280 A * 1/1967 Rahm ..... F41A 21/36 89/14.3
4,691,614 A * 9/1987 Leffel ..... F41A 21/36 89/14.3
5,036,747 A 8/1991 McClain, III
5,652,406 A 7/1997 Phan
5,814,757 A 9/1998 Buss
6,216,578 B1 4/2001 Ledys et al.
6,269,727 B1 8/2001 Nigge
6,276,251 B1 8/2001 Downing et al.
6,425,310 B1 7/2002 Champion
6,722,254 B1 4/2004 Davies
7,143,680 B2 * 12/2006 Bender ..... F41A 21/38 89/14.3
7,296,505 B2 11/2007 Balbo et al.
7,328,645 B1 2/2008 Curry et al.
7,587,969 B2 * 9/2009 Silvers ..... F41A 21/30 181/223
7,937,869 B2 5/2011 Levin
7,946,069 B2 5/2011 Dueck et al.
7,954,414 B2 6/2011 Dueck et al.
8,087,337 B1 1/2012 Cary
8,099,892 B1 1/2012 Strömberg
8,205,538 B2 6/2012 Dueck et al.
(Continued)

OTHER PUBLICATIONS

Muzzlebrakeparts.com, "6 Inch .223 Muzzle Brake ½x28 TPI Compensator Aluminium 7075 Reduces Recoil Multiport", https://www.muzzlebrakeparts.com/6-inch-223-muzzle-brake-12x28-tpi-compensator-aluminium-7075-reduces-recoil-multiport-p1463202.html, Nov. 28, 2019.*

(Continued)

*Primary Examiner* — Joshua T Semick
(74) *Attorney, Agent, or Firm* — Luedeka Neely Group, PC

(57) ABSTRACT

A muzzle brake has a first forward sloping wall and a second forward sloping wall located between a rear wall and a front wall, the first and second forward sloping walls each being disposed at an angle of from about 50 degrees to about 70 degrees relative to the length axis of the muzzle brake; and a top wall and an opposite bottom wall extending parallel to the length axis of the muzzle brake. A first open-sided blast chamber is defined between the rear wall, the first forward sloping wall and the top and bottom walls; a second open-sided blast chamber is defined between the first forward sloping wall, the second forward sloping wall, and the top and bottom walls; and a third open-sided blast chamber is defined between the second forward sloping wall, the front wall, and the top and bottom walls.

15 Claims, 8 Drawing Sheets

(56) References Cited

U.S. PATENT DOCUMENTS

| | | | | |
|---|---|---|---|---|
| 8,342,071 | B2 | 1/2013 | Hortobagyi | |
| 8,505,431 | B2 | 8/2013 | Hines | |
| 8,578,832 | B2 | 11/2013 | Adolphsen | |
| 8,627,755 | B1 | 1/2014 | Eckel | |
| 8,707,846 | B2 | 4/2014 | Kohnen | |
| 8,800,419 | B1 | 8/2014 | Walker | |
| D729,894 | S * | 5/2015 | DeLuca | D22/108 |
| 9,303,939 | B1 * | 4/2016 | Brinkmeyer | F41A 21/38 |
| 9,683,802 | B2 * | 6/2017 | Geissele | F41A 21/36 |
| D835,226 | S * | 12/2018 | Haman | D22/108 |
| 10,156,411 | B2 * | 12/2018 | Thompson | F41A 21/36 |
| D842,960 | S * | 3/2019 | Liu | D22/108 |
| D846,684 | S * | 4/2019 | Montes | D22/108 |
| 10,767,952 | B1 * | 9/2020 | Till | F41A 21/36 |
| 10,788,283 | B2 * | 9/2020 | Joplin | F41A 21/38 |
| 2021/0207918 | A1 * | 7/2021 | Collins | F41A 21/38 |

OTHER PUBLICATIONS

Lewis Machine and Tool Company, ".308 ⅝×24 Muzzle Brake", https://lmtdefense.com/product/308-5-8x24-muzzle-brake/.*

"Muzzle brake, the more holes, the better?", https://www.snipershide.com/shooting/threads/muzzle-brake-the-more-holes-the-better.6942690/#post-7729029 (Year: 2019).*

* cited by examiner

MUZZLE BRAKE

FIELD

This disclosure relates to the field of muzzle brakes. More particularly, the disclosure relates to muzzle brakes having improved aesthetics, versatility, and ability to counter the recoil of the firearm and reduce the rise of the barrel.

BACKGROUND

During the firing of a firearm, propellant gases propel a bullet down a barrel and as the bullet exits the barrel the propellant gases also exit the barrel. Associated with the firing of the firearm is a recoil of the firearm and a rise or upward movement of the barrel resulting from the exit of the propellant gases from the barrel. Muzzle brakes are devices locatable on the exit end of a firearm barrel to counter the recoil of the firearm and reduce the rise of the barrel. Improvement is desired for such devices.

The present disclosure provides an improved muzzle brake construction that advantageously counters recoil and reduces the rise of the barrel as compared to prior muzzle brake structures and offers other advantages, including improved aesthetics and versatility.

SUMMARY

The above and other needs are met by a muzzle brake having improved structure, performance, and aesthetics.

In one aspect, a muzzle brake according to the disclosure includes a rear wall spaced from a front wall, the rear wall and the front wall each being perpendicular to a length axis of the muzzle brake. The muzzle brake also has a first forward sloping wall and a second forward sloping wall located between the rear wall and the front wall, the first and second forward sloping walls each being disposed at an angle of from about 50 degrees to about 70 degrees relative to the length axis of the muzzle brake; and a top wall and an opposite bottom wall extending parallel to the length axis of the muzzle brake.

A first bullet passage aperture extends through the rear wall, a second bullet passage aperture extends through the first forward sloping wall, a third bullet passage aperture extends through the second forward sloping wall, and a fourth bullet passage aperture extends through the front wall. The first, second, third, and fourth bullet passage apertures are concentric and aligned with the length axis of the muzzle brake;

A first open-sided blast chamber is defined between the rear wall, the first forward sloping wall and the top and bottom walls; a second open-sided blast chamber is defined between the first forward sloping wall, the second forward sloping wall, and the top and bottom walls; and a third open-sided blast chamber is defined between the second forward sloping wall, the front wall, and the top and bottom walls.

In another aspect, a muzzle brake according to the disclosure includes a rear wall spaced from a front wall, the rear wall and the front wall each being perpendicular to a length axis of the muzzle brake; a first forward sloping wall and a second forward sloping wall located between the rear wall and the front wall; a first open-sided blast chamber defined between the rear wall, the first forward sloping wall and the top and bottom walls;

a second open-sided blast chamber defined between the first forward sloping wall, the second forward sloping wall, and the top and bottom walls; and a third open-sided blast chamber defined between the second forward sloping wall, the front wall, and the top and bottom walls.

In a further aspect, a muzzle brake according to the disclosure includes a first open-sided blast chamber having a triangular configuration; a second open-sided blast chamber forward of the first open-sided blast chamber and configured as a quadrilateral; and a third open-sided blast chamber forward of the second open-sided blast chamber and having a triangular configuration.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
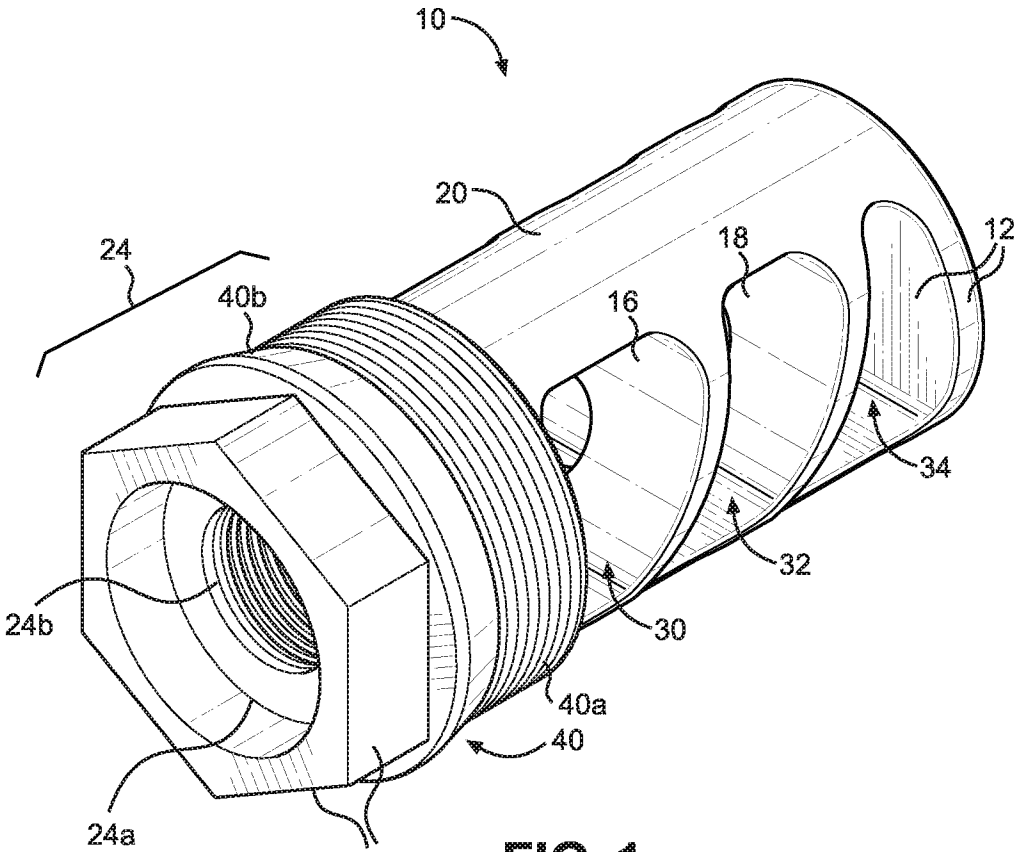
FIG. 1 shows a muzzle brake according to the disclosure.
Figure 2:
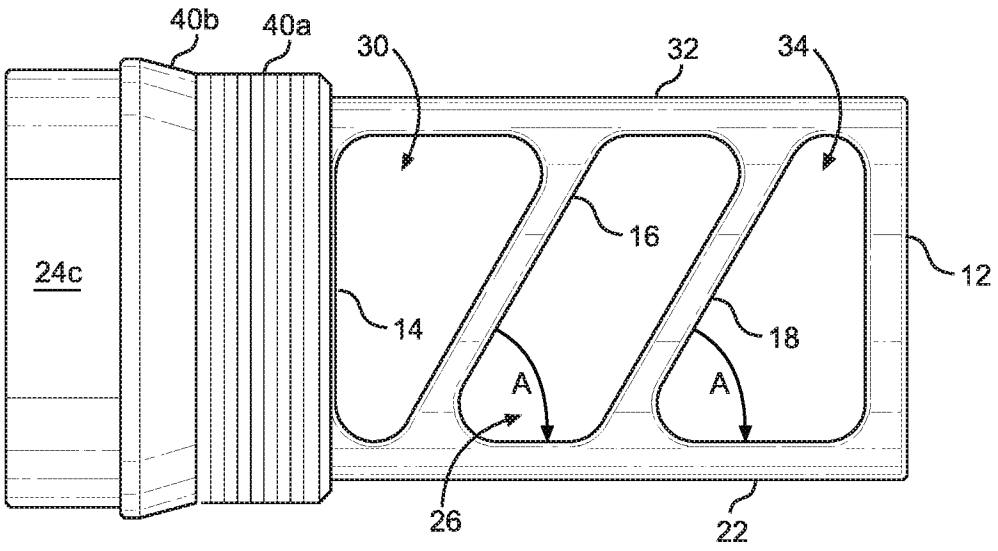
FIG. 2 is a right side view of the muzzle brake of FIG. 1.
Figure 3:
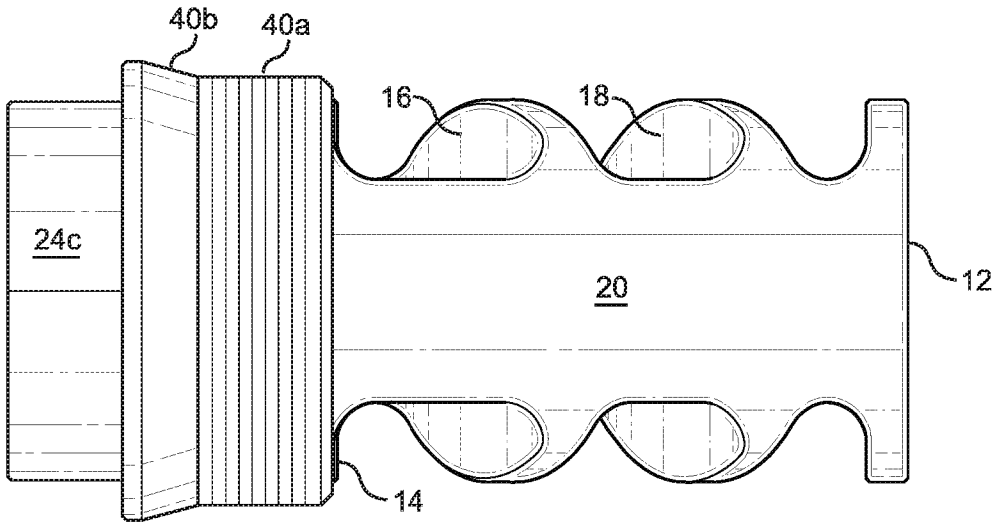
FIG. 3 is a top view of the muzzle brake of FIG. 1.
Figure 4:
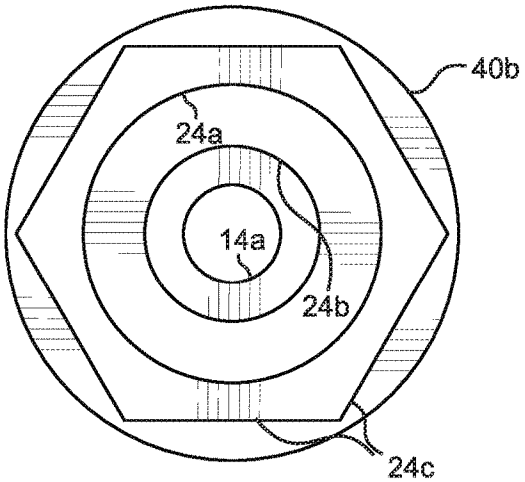
FIG. 4 is a rear end view of the of the muzzle brake of FIG. 1.
Figure 5:
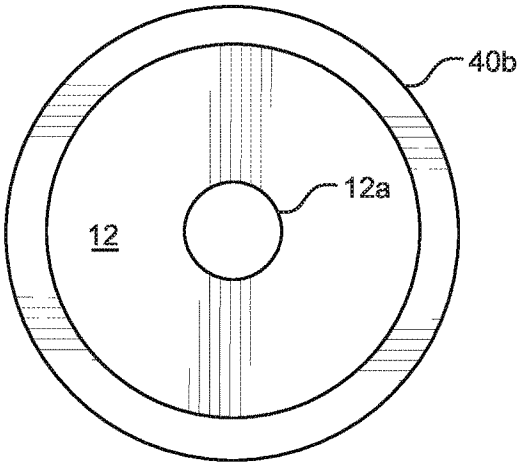
FIG. 5 is a front end view of the of the muzzle brake of FIG. 1.

With initial reference to FIGS. 1-5, there is shown a muzzle brake 10 according to the disclosure. The muzzle brake 10 is advantageously configured to include structural and functional features that enable improved versatility and performance compared to conventional muzzle brakes. The appearance of the muzzle brake 10 is also configured to be aesthetically pleasing and includes various ornamental aspects and features.

As seen in FIGS. 6A-6B, 7A-7C, and 8A-8C, the muzzle brake 10 is configured to be threadably mounted to a threaded end of a firearm barrel FB having a firearm barrel bore FBB (FIG. 8A) with barrel threads BT located at the exit end of the firearm barrel FB. In broad overview, during the firing of the firearm, propellant gases G propel a bullet B down the bore FBB of the firearm barrel FB and as the bullet B exits the barrel FB the propellant gases G also exit the barrel FB. The muzzle brake 10 is installed onto the exit end of the firearm barrel FB to alter the flow of the propellant gases G to desirably counter recoil of the firearm and reduce rise of the barrel FB during firing. In this regard, the muzzle brake 10 is configured to disperse the flow of propellant gases in a staged and controlled manner to offer improved countering of recoil and reduction of barrel rise as compared to conventional muzzle brakes.

Returning to FIGS. 1-5, the muzzle brake 10 is of one-piece construction and made of a rigid material suitable for muzzle brake purposes, and preferably 416 stainless steel. The muzzle brake 10 is generally cylindrical in shape and includes a front wall 12, a rear wall 14, forward sloping walls 16 and 18, top wall 20 and bottom wall 22. The walls 12, 14, 16 and 18 include aligned concentric apertures 12*a*, 14*a*, 16*a*, and 18*a*, respectively, aligned and concentric with the firearm barrel bore FBB configured for travel of the bullet B from the firearm barrel bore FBB and through the muzzle brake 10. The aligned apertures 12*a*-18*a* define a length axis of the muzzle brake 10 which corresponds to the length axis of the firearm barrel FB. A barrel connector 24 section of the muzzle brake 10 is located rearward of the rear wall 14. The wall structures 12-22 define a series of open-sided blast chambers 30, 32, and 34.

The barrel connector 24 includes an interior smooth section 24*a* having a diameter configured to receive the end of the firearm barrel FB and a smaller diameter interior threaded section 24*b* configured to threadably receive the barrel threads BT of the firearm barrel FB. The exterior of the barrel connector 24 is desirably configured to include wrench flats 24*c* at the rear of the barrel connector 24 configured for receiving a box wrench or a crescent wrench or the like for installation of the muzzle brake 10 onto the firearm barrel FB.)

The wrench flats 24*c* also facilitate desirable orientation of the muzzle brake 10 during installation. In this regard, one of the wrench flats 24*c* is aligned with the top wall 20 and it is desirable to install the muzzle brake 10 so that the wrench flat 24*c* that is aligned with the top wall 20 is horizontal relative to the length axis of the firearm barrel FB. This is accomplished by locating the wrench flat 24*c* that is aligned with the top wall 20 in the top or 12 o'clock position to align the muzzle brake 10 to a top dead center orientation.

Figure 6A:
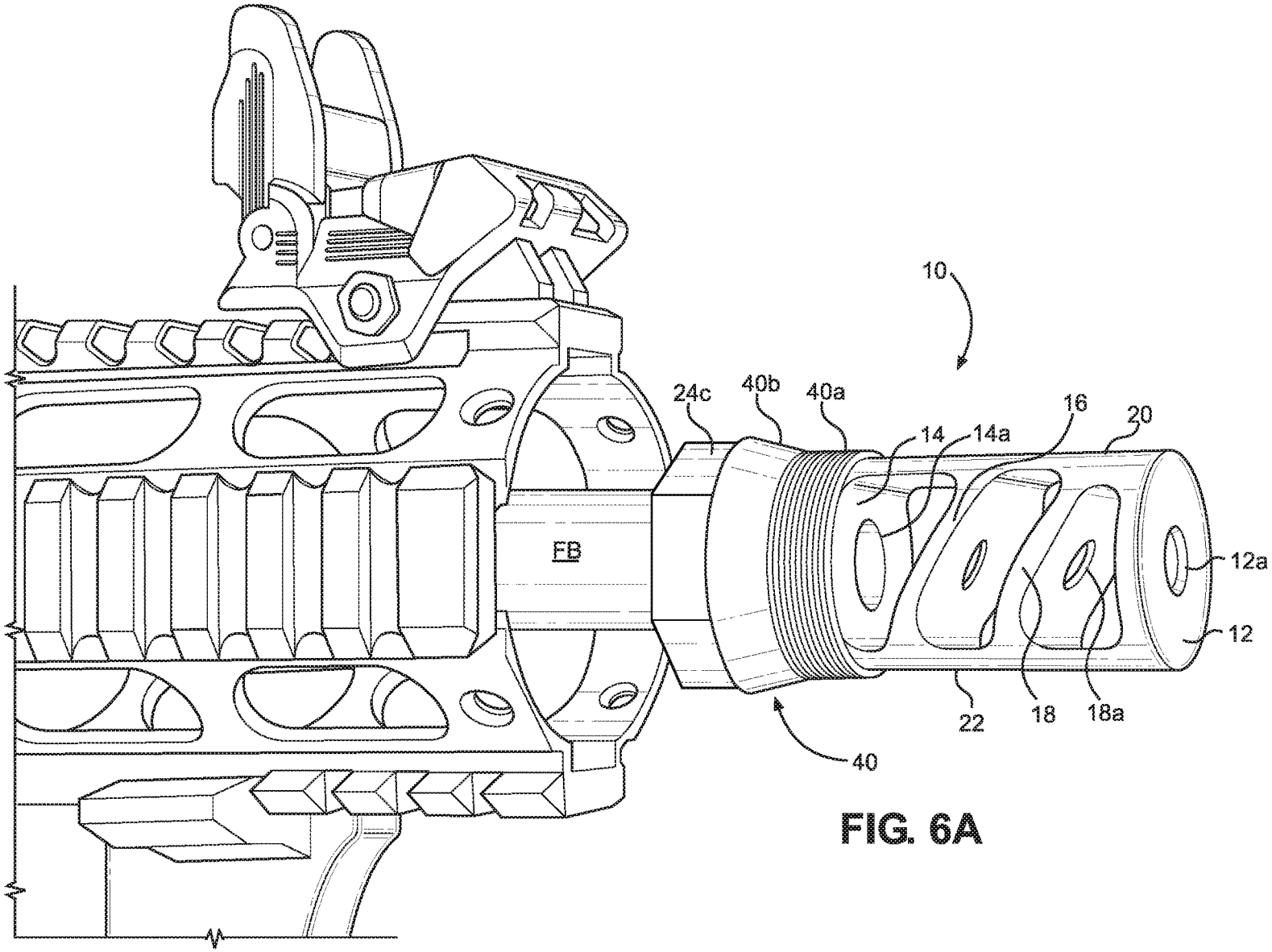
FIG. 6A shows the muzzle brake installed on a firearm and FIG. 6B is an exploded view thereof.
Figure 6B:
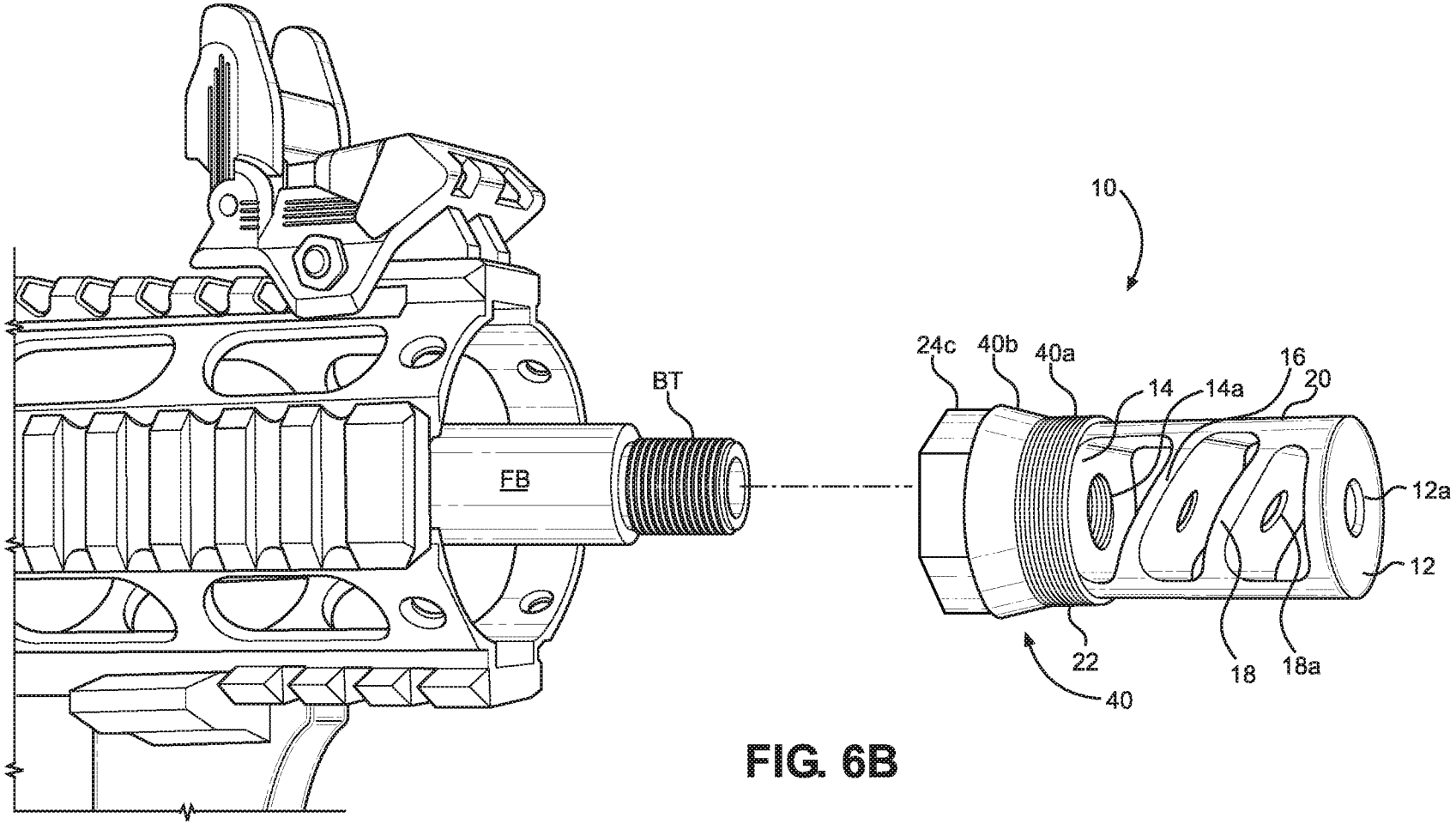
Figure 6C:
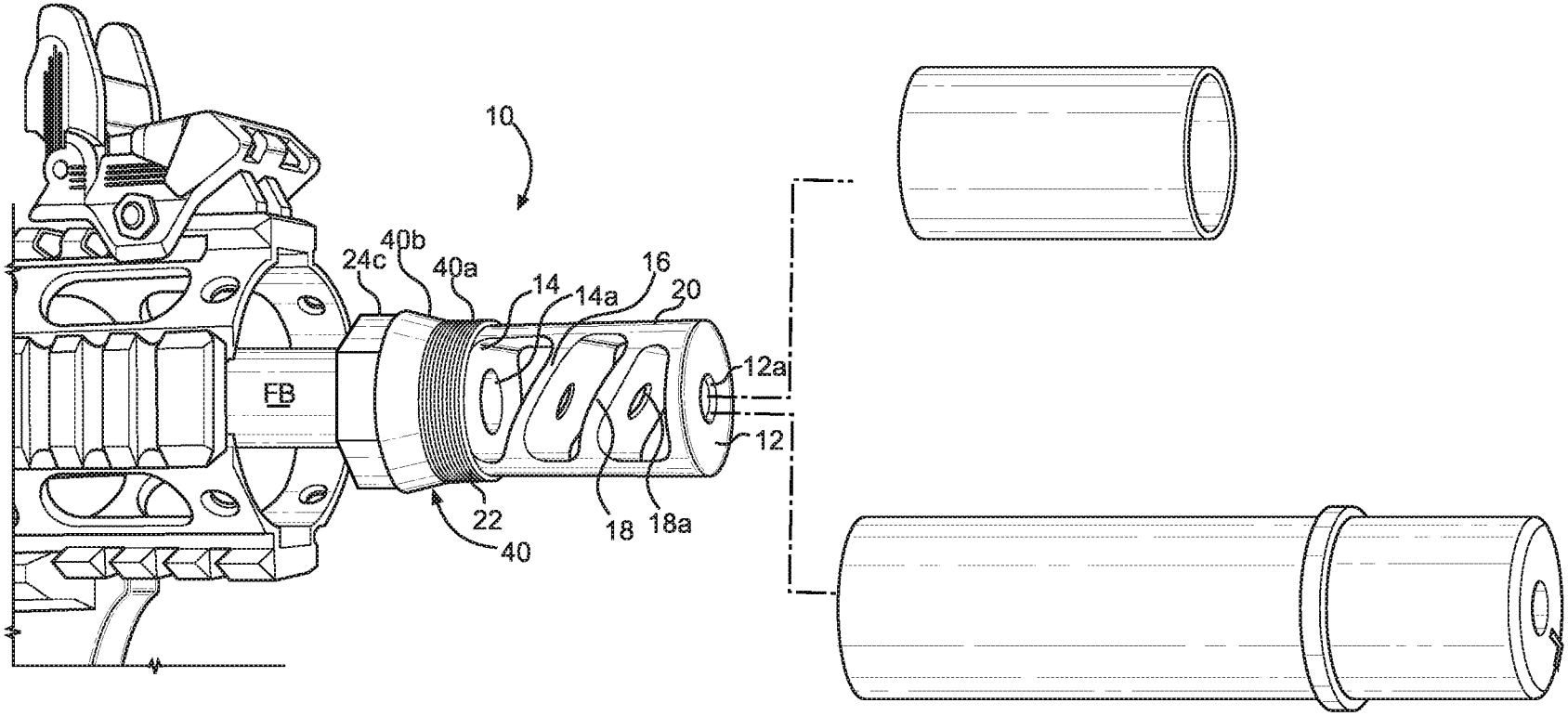
FIG. 6C shows firearm accessories that can be added to the muzzle brake.
Figure 7A:
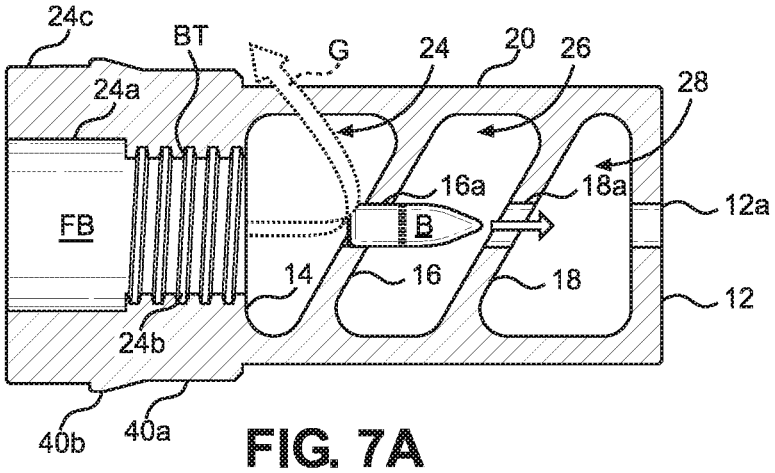
FIGS. 7A-7C are cross-sectional side views depicting the travel of a bullet through the muzzle brake and the effect the muzzle brake has on the propellant gases.
Figure 7B:
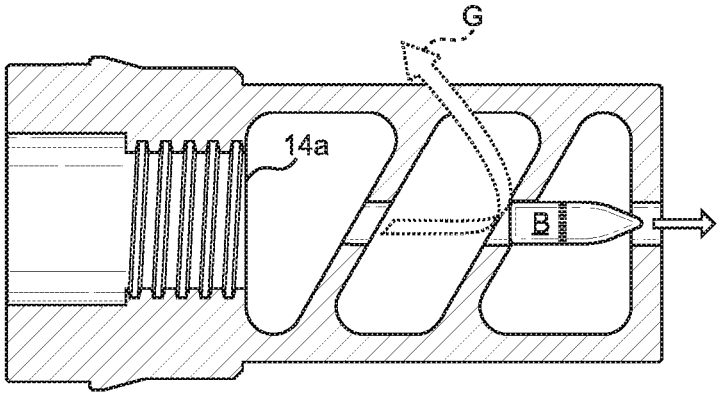
Figure 7C:
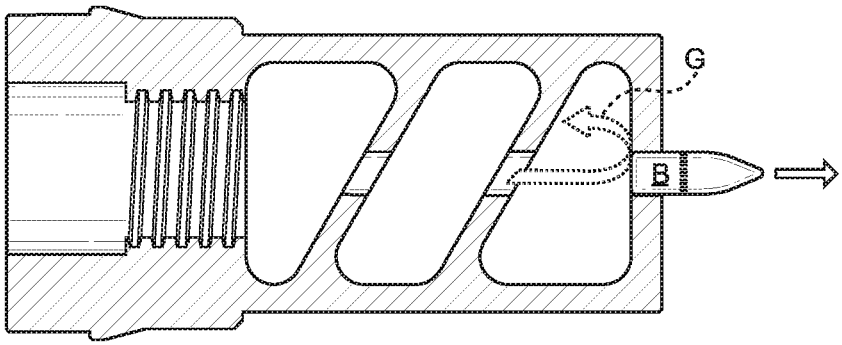
Figure 8A:
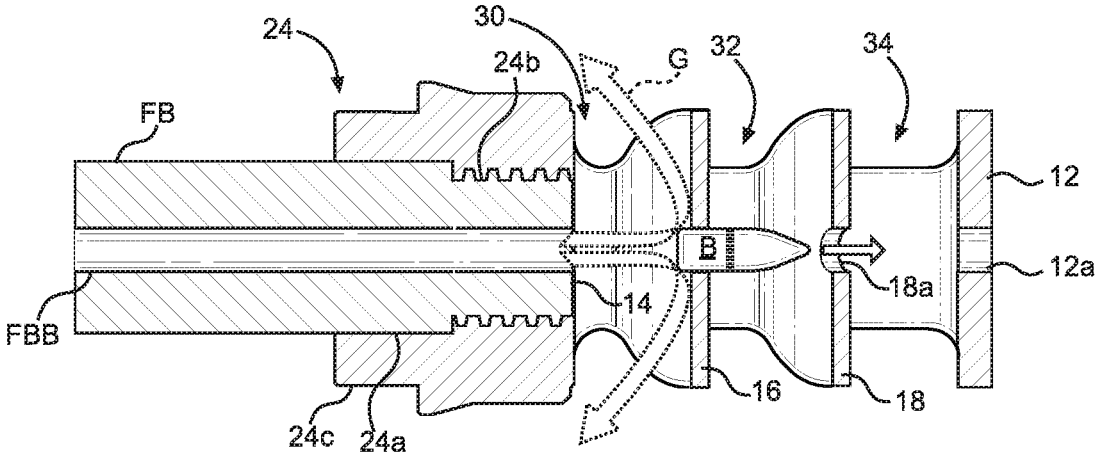
FIGS. 8A-8C are cross-sectional top views depicting the travel of the bullet through the muzzle brake and the effect the muzzle brake has on the propellant gases.
Figure 8B:
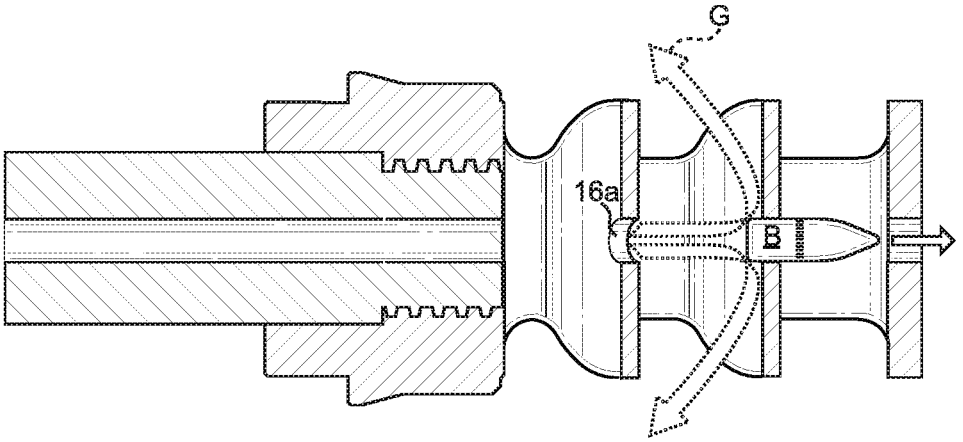
Figure 8C:
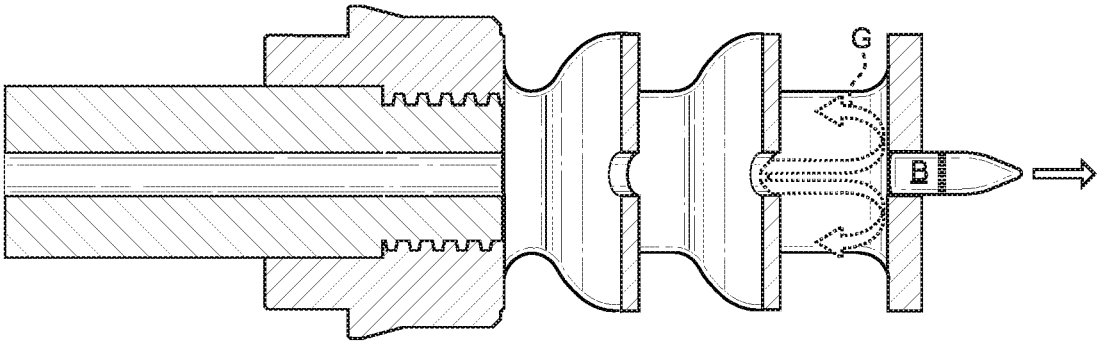

A front of the exterior of the barrel connector 24 is configured to provide an optional accessory receiver 40, having a tapered shoulder 40*a* and exterior threads 40*b*. As shown in FIG. 6C, the accessory receiver 40 is configured to threadably and snugly receive firearm accessories such as a silencer or a suppressor S or a blast shield BS or other accessory. The tapered shoulder 40*a* enables a snug fit with firearm accessories of a variety of diameters that can fit over the muzzle brake 10. To accomplish this, the taper of the shoulder 40*a* extends outwardly of the length axis of the muzzle brake 10 at an angle of from about 25 to about 35 degrees, most preferably about 30 degrees relative to the length axis of the muzzle brake 10.

A critical aspect of the disclosure relates to the structure of the muzzle brake 10 having at least two forward sloping walls at the forward position of at least two open-sided blast chambers, and a substantially 90-degree wall at the forward position of the last chamber. In this regard, the muzzle brake 10 includes the blast chambers 30 and 32 having the forward sloping sidewalls 16 and 18, respectively, and the following blast chamber 34 having the front wall 12 which is 90 degrees (perpendicular) relative to the length axis of the muzzle brake 10. The rear wall 14 is also perpendicular to the length axis of the muzzle brake 10. The top wall 20 and the bottom wall 20 each extend parallel to the length axis of the muzzle brake 10.

The forward sloping sidewalls 16 and 18 are each forward sloped at an angle A of between about 50 degrees and 70 degrees relative to the length axis of the muzzle brake, and most preferably about 60 degrees. The sidewalls 16 and 18 are desirably sloped forward at the same angle, but may be sloped at different angles from one another.

The blast chambers 30 and 34 are each configured as a triangle and are oriented inverse to one another. The blast chamber 32 is configured as a quadrilateral. The corners of the blast chambers 30, 32 and 34 are preferably radiused. This facilitates manufacture and provides improved aesthetics and gas flow characteristics.

With additional reference to FIGS. 7A-7C, and 8A-8C, there is shown the affect that the muzzle brake 10 has on the propellant gases G as they exit the firearm barrel FB and travel through the muzzle brake 10 for staged or controlled exit from the muzzle brake 10. For the described muzzle brake 10 which is configured for use with a .223 caliber firearm, the muzzle brake 10 is configured so that from about 60-70%, most preferably about 65% of the propellant gases G exit from the blast chamber 30, from about 20-30%, most preferably about 25% of the propellant gases exit from the blast chamber 32, and from about 5-10%, most preferably about 10% of the propellant gases G exit from the blast chamber 34.

It has been observed that muzzle brakes according to the disclosure function to vent the propellant gases G that enter the muzzle brake 10 in the described staged and controlled manner and thereby reduce the recoil of the firearm and the rise or upward movement of the firearm barrel FB. In operation, the muzzle brake 10 is observed to reduce recoil and barrel rise by about 70-80% as compared to operation of the firearm without the muzzle brake 10.

The muzzle brake 10 is also aesthetically pleasing, compact and lightweight. For example, for the described embodiment configured for use with a .223 caliber rifle, the muzzle brake has a weight of about 4.3 ounces and is compact with an overall length of about 2.3 inches, and adds only about 1.5 inches to the overall length of the firearm when installed.

Accordingly, the present device advantageously provides a muzzle brake having improved aesthetics, versatility, and ability to counter the recoil of the firearm and reduce the rise of the barrel.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A muzzle brake, comprising:

a rear wall spaced from a front wall, the rear wall and the front wall each being perpendicular to a length axis of the muzzle brake;

a first forward sloping wall and a second forward sloping wall located between the rear wall and the front wall, the first and second forward sloping walls each being disposed at an angle of from about 50 degrees to about 70 degrees relative to the length axis of the muzzle brake;

a top wall and an opposite bottom wall extending parallel to the length axis of the muzzle brake;

a first bullet passage aperture through the rear wall, a second bullet passage aperture through the first forward sloping wall, a third bullet passage aperture through the second forward sloping wall, and a fourth bullet passage aperture through front wall, the first, second, third, and fourth bullet passage apertures being concentric and aligned with the length axis of the muzzle brake;

a first open-sided blast chamber defined by and continuous between the rear wall, the first forward sloping wall and the top and bottom walls;

a second open-sided blast chamber defined by and continuous between the first forward sloping wall, the second forward sloping wall, and the top and bottom walls; and a third open-sided blast chamber defined by and continuous between the second forward sloping wall, the front wall, and the top and bottom walls.

2. The muzzle brake of claim 1, wherein the first and third blast chambers are each configured as a triangle and are oriented inverse to one another, and the second blast chamber is configured as a quadrilateral.

3. The muzzle brake of claim 1, further comprising a barrel connector section located rearward of the rear wall and having wrench flats thereon.

4. The muzzle brake of claim 1, further comprising a barrel connector section located rearward of the rear wall and having an accessory receiver thereon including a tapered shoulder and exterior threads.

5. The muzzle brake of claim 1, wherein the muzzle brake is operative to disperse flow of propellant gases therethrough such that as the propellant gases flow through the muzzle brake, from about 60-70% of the propellant gases exit the muzzle brake from the first blast chamber, from about 20-30% of the propellant gases exit the muzzle brake from the second blast chamber, and from about 5-10% of the propellant gases exit the muzzle brake from the third blast chamber.

6. A muzzle brake, comprising:

a rear wall spaced from a front wall, the rear wall and the front wall each being perpendicular to a length axis of the muzzle brake;

a first forward sloping wall and a second forward sloping wall located between the rear wall and the front wall;

a first open-sided blast chamber defined by and continuous between the rear wall and the first forward sloping wall;

a second open-sided blast chamber defined by and continuous between the first forward sloping wall and the second forward sloping wall; and a third open-sided blast chamber defined by and continuous between the second forward sloping wall and the front wall.

7. The muzzle brake of claim 6, wherein the first and second forward sloping walls are each disposed at an angle of from about 50 degrees to about 70 degrees relative the length axis of the muzzle brake.

8. The muzzle brake of claim 6, further comprising a first bullet passage aperture through the rear wall, a second bullet passage aperture through the first forward sloping wall, a third bullet passage aperture through the second forward sloping wall, and a fourth bullet passage aperture through front wall, the first, second, third, and fourth bullet passage apertures being concentric and aligned with the length axis of the muzzle brake.

9. The muzzle brake of claim 6, further comprising a top wall and an opposite bottom wall extending parallel to length axis of the muzzle brake.

10. The muzzle brake of claim 6, wherein the first and third blast chambers are each configured as a triangle and are oriented inverse to one another, and the second blast chamber is configured as a quadrilateral.

11. The muzzle brake of claim 6, further comprising a barrel connector section located rearward of the rear wall and having wrench flats thereon.

12. The muzzle brake of claim 6, further comprising a barrel connector section location rearward of the rear wall and having an accessory receiver thereon including a tapered shoulder and exterior threads.

13. The muzzle brake of claim 6, wherein the muzzle brake is operative to disperse flow of propellant gases therethrough such that as the propellant gases flow through the muzzle brake, from about 60-70% of the propellant gases exit the muzzle brake from the first blast chamber, from about 20-30% of the propellant gases exit the muzzle brake from the second blast chamber, and from about 5-10% of the propellant gases exit the muzzle brake from the third blast chamber.

14. A muzzle brake, comprising: a first open-sided blast chamber having a triangular configuration; a second open-sided blast chamber forward of the first open-sided blast chamber with no intervening blast chambers and configured as a quadrilateral; and a third open-sided blast chamber forward of the second open-sided blast chamber with no intervening blast chambers and having a triangular configuration.

15. The muzzle brake of claim 14, wherein the muzzle brake is operative to disperse flow of propellant gases therethrough such that as the propellant gases flow through the muzzle brake, from about 60-70% of the propellant gases exit the muzzle brake from the first blast chamber, from about 20-30% of the propellant gases exit the muzzle brake from the second blast chamber, and from about 5-10% of the propellant gases exit the muzzle brake from the third blast chamber.

* * * * *